United States Patent [19]

Nixon et al.

[11] Patent Number: 4,948,931

[45] Date of Patent: Aug. 14, 1990

[54] COMBINED PRESSURE CUTOFF AND PRESSURE RELIEF VALVE

[75] Inventors: Ronald A. Nixon, Mansfield; Charles Yagher, Jr., Lexington, both of Ohio

[73] Assignee: Therm-O-Disc, Incorporated, Mansfield, Ohio

[21] Appl. No.: 340,141

[22] Filed: Apr. 17, 1989

[51] Int. Cl.[5] ..... H01H 35/34

[52] U.S. Cl. ..... 200/83 P; 200/61.08; 200/83 W; 200/306

[58] Field of Search ..... 307/118; 91/1; 92/5 R; 73/717, 723; 200/61.08, 302.1, 306, 83 R, 83 A, 83 J, 83 P, 83 Q, 83 W; 340/626

[56] References Cited

U.S. PATENT DOCUMENTS

| | | | |
|---|---|---|---|
| 2,075,305 | 3/1937 | Sayre . | |
| 3,585,328 | 6/1971 | Fiore et al. . | |
| 4,091,249 | 5/1978 | Huffman . | |
| 4,117,287 | 9/1978 | Walker | 200/61.08 |
| 4,150,266 | 4/1979 | Patrichi | 200/61.08 |
| 4,191,870 | 3/1980 | Yanagisawa . | |
| 4,243,858 | 1/1981 | Place . | |
| 4,400,601 | 8/1983 | Brucken | 200/83 Q |
| 4,645,888 | 2/1987 | Barkan et al. . | |
| 4,794,214 | 12/1988 | Sanford | 200/83 P |

*Primary Examiner*—Gerald P. Tolin

*Attorney, Agent, or Firm*—Jones, Day, Reavis & Pogue

[57] ABSTRACT

A combined pressure cutoff and pressure relief valve includes a normally closed switch movable between closed and open contact positions. A normally closed pressure relief vent is located in a common housing with the switch. A pressure responsive diaphragm applies force to a switch snap disc and a vent snap disc. Under high pressure conditions, the switch snap disc snaps and opens a pair of contacts. In the event an abnormal pressure condition occurs, the vent snap disc operates and causes a pin to rupture the diaphragm for opening the relief vent.

11 Claims, 3 Drawing Sheets

Fig. 2
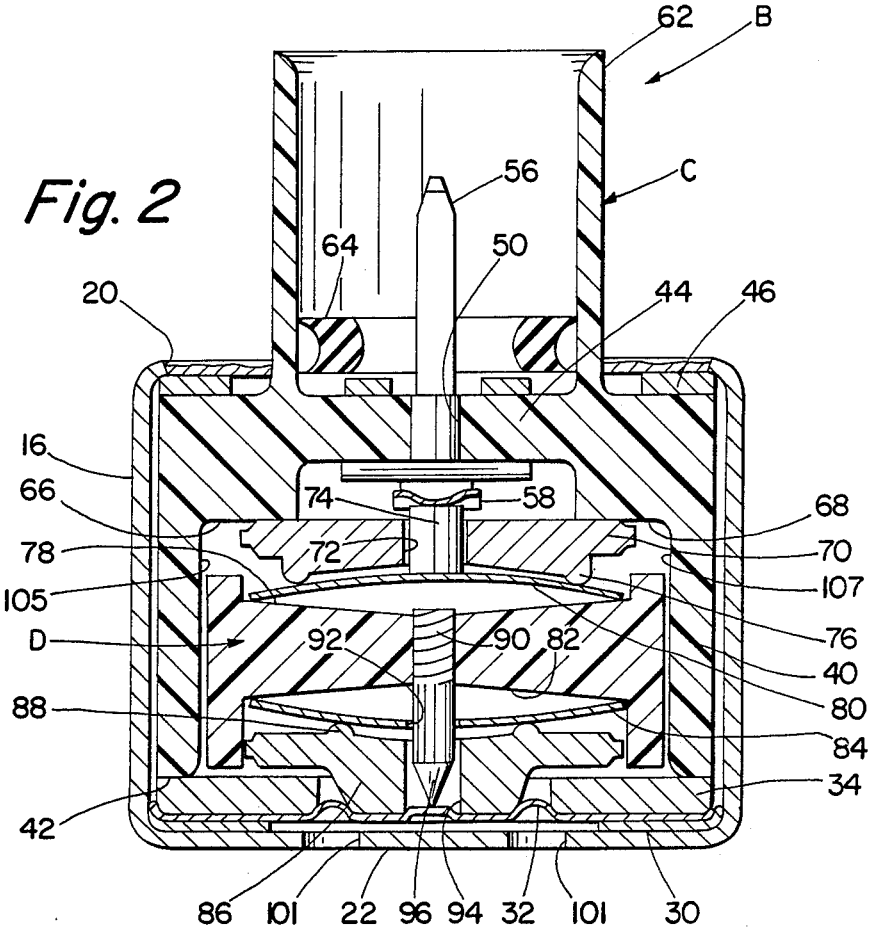
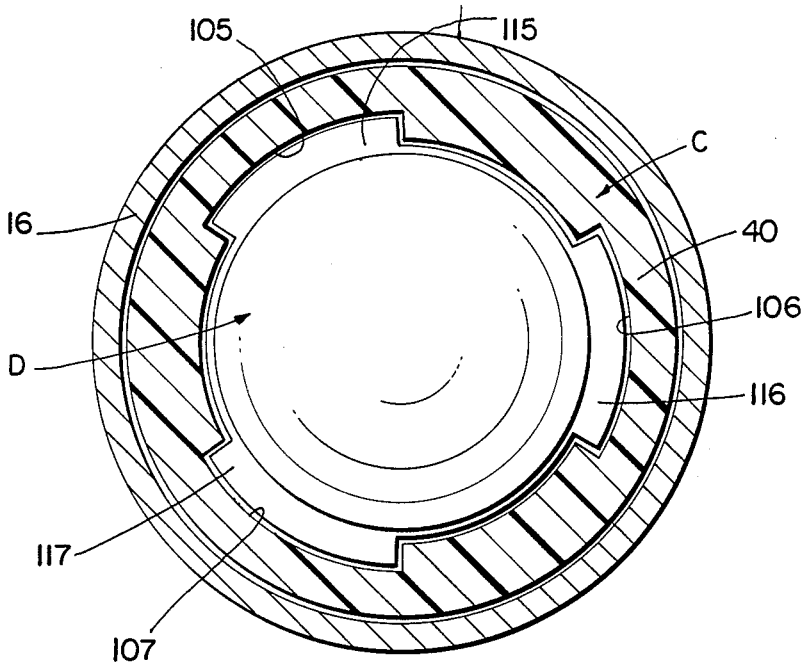
Fig. 3

COMBINED PRESSURE CUTOFF AND PRESSURE RELIEF VALVE

BACKGROUND OF THE INVENTION

This application relates to the art of pressure cutoffs and pressure relief valves and, more particularly, to a unitary assembly that performs the combined functions of a pressure cutoff and a pressure relief valve. The invention is particularly applicable for use with air conditioner compressors and will be described with specific reference thereto. However, it will be appreciated that the invention has broader aspects and can be used for regulating and relieving pressure in other devices.

Air conditioner compressors are commonly provided with a pressure cutoff switch for turning the compressor off when a predetermined pressure is reached. When the pressure subsequently falls below the predetermined pressure, the compressor is again turned on. The pressure cutoff cycles the compressor off during high pressure conditions and back to on when the pressure is again at a normal level.

In the event of a malfunction, such as an electrical failure or externally applied heat, the pressure cutoff may not turn the compressor off. The pressure will then continue to build and could result in explosion of the air conditioning system. To prevent such an explosion, it is common to provide a pressure relief valve for venting the pressure when it exceeds a predetermined value.

It would be desirable to have a unitary assembly for performing the dual functions of providing a pressure cutoff and a pressure relief valve in a reliable and simplified manner.

SUMMARY OF THE INVENTION

A combined pressure cutoff and pressure relief valve is constructed as a unitary assembly in a common housing. The pressure cutoff portion of the device includes a normally closed switch movable between closed and open positions. Movable switch operating means is provided for moving the switch between its closed and open positions.

A normally closed pressure relief vent is provided in the same housing which encloses the switch. Movable vent operating mean is provided for opening the vent.

Movable pressure responsive means is movable in response to the outlet pressure of an air conditioning compressor. When a first predetermined pressure is reached, force applied by the pressure responsive means to the switch operating means opens the switch. When the pressure subsequently falls to a certain point below the first predetermined pressure, the force acting on the switch operating means by the pressure responsive means is reduced and the switch closes to turn the compressor back on. The switch cycles the compressor off during high pressure conditions and cycles the compressor back on when the pressure returns to a normal level.

In the event of a malfunction that results in a second predetermined pressure greater than the first predetermined pressure, the pressure responsive means responds to the second predetermined pressure for applying force to the vent operating means for opening the vent to thereby vent the pressure.

In a preferred arrangement, both the switch operating means and the vent operating means include snap discs that are capable of providing rapid pressure cutoff and pressure relief at relatively precise pressures.

In one arrangement, the pressure responsive means comprises a diaphragm, and a pin is positioned in the housing for piercing the diaphragm to open the relief vent when the vent snap disc operates responsive to the second predetermined pressure.

It is a principal object of the present invention to provide a combined pressure cutoff and pressure relief valve in a unitary assembly.

It is also an object of the invention to provide an improved combined pressure cutoff and pressure relief valve that is very reliable in operation.

It is an additional object of the invention to provide a combined pressure cutoff and pressure relief valve that is very compact and relatively simple to manufacture and assemble.

It is also an object of the invention to provide a combined pressure cutoff and pressure relief valve that has relatively simple operating characteristics.

BRIEF DESCRIPTION OF THE DRAWING

FIG. 2 is a partial cross-sectional elevational view taken generally on line 2—2 of FIG. 1;

FIG. 3 is a partial cross-sectional plan view taken generally on line 3—3 of FIG. 1.

DESCRIPTION OF PREFERRED EMBODIMENTS

Figure 1:
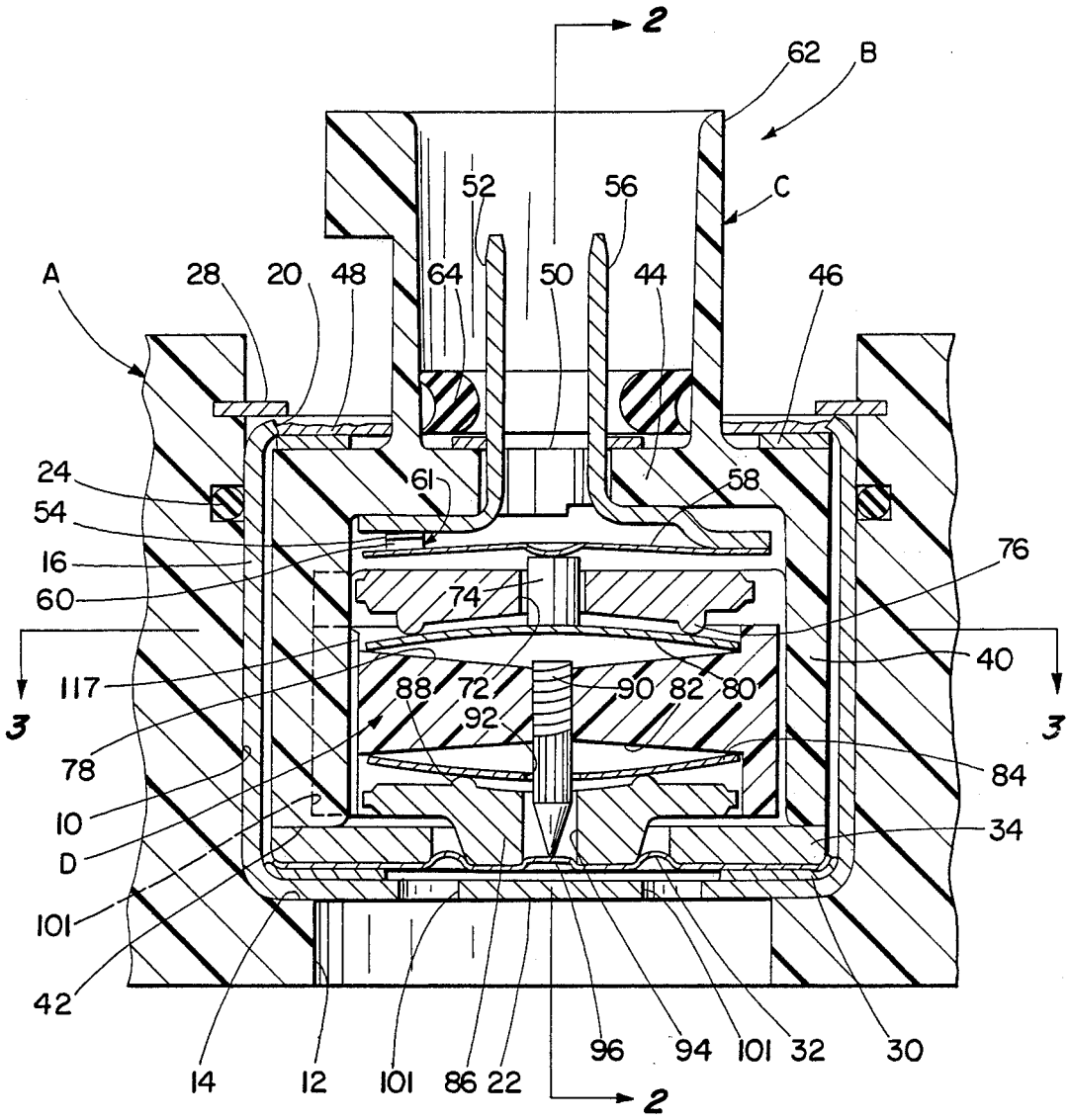
FIG. 1 is a cross-sectional elevational view showing a combined pressure cutoff and pressure relief valve constructed in accordance with the present application.

Referring now to the drawing, wherein the showings are for purposes of illustrating certain preferred embodiments of the invention only and not for purposes of limiting same, FIG. 1 shows a portion of a compressor cylinder head A having a cylindrical bore 10 therein. A passage 12 connected with the outlet pressure on the outlet side of the compressor intersects bore 10 at a shoulder 14.

A combined pressure cutoff and pressure relief valve B is constructed as a unitary assembly in a common housing. The housing includes a generally cylindrical cup-like outer shell 16 having an open end 20 and a partly closed end 22. Outer shell 16 is closely received in bore 10 of cylinder head A with partly closed end 22 engaging shoulder 14. An 0-ring 24 positioned within a circumferential groove in bore 10 sealingly engages the outer periphery of shell 16. A snap ring 28 positioned in a circumferential groove in bore 10 engages open end 20 of shell 16 for retaining combined pressure cutoff and pressure relief valve B within bore 10.

A sealing disc 30 of rubber or the like is positioned within shell 16 against the inner surface of partly closed end 22 adjacent its intersection with the outer peripheral wall of shell 16. A flexible diaphragm 32 is positioned within shell 16, and its outer peripheral portion bears against sealing ring 30. A retainer disc 34 is positioned against diaphragm 32 on the opposite side thereof from sealing ring 30.

A housing member C has a generally cylindrical peripheral wall 40 received within shell 16 and having a circular terminal end 42 engaging retainer disc 34. Housing member C includes an end wall 44. A crimp ring 46 is positioned against the outer surface of end wall 44, and open end 20 of shell 16 is crimped over as shown to retain housing member C within shell 16. A suitable sealant 48 is applied over crimp ring 46 and end wall 44 of housing C.

End wall 44 on housing member C has a pressure relief vent opening 50 therethrough. This pressure relief vent is normally closed by diaphragm 32 against venting pressure from passage 12. A stationary contact support terminal 52 extends through end wall 44 of housing member C and has a fixed contact 54 mounted thereon within housing member C. A movable contact support terminal 56 extends through end wall 44 and has a movable switch arm 58 mounted thereon. A movable contact 60 mounted adjacent to the free end portion of movable ar 58 cooperates with a fixed contact 54. Contacts 54, 60 and movable switch arm 58 define a switch 61 having open and closed positions. Switch arm 58 is stressed to normally bias switch 61 open. However, other components to be described hold switch 61 normally closed. A collar 62 extends outwardly from housing member end wall 44 in surrounding relationship to terminals 52, 56 and an insulating ring 64 is positioned within collar 62 around the terminals.

The inner surface of end wall 44 on housing member C is stepped to provide a pair of spaced-apart shoulders 66, 68 on opposite sides of movable switch arm 58. A primary pressure reducer disc 70 is positioned against shoulders 66, 68 and has a central hole 72 therethrough slideably receiving a cylindrical pin 74. Disc actuating means is provided on primary pressure reducer disc 70 in the form of a ring-like projection 76.

A movable force transfer member D positioned within housing member C has a cavity 78 at one end thereof providing a seat for a switch snap disc 80 that is normally bowed to the position shown in FIGS. 1 and 2 for acting through transfer pin 74 on switch arm 58 to hold contact 60 engaged with contact 54 so the switch 61 is normally closed.

The opposite end of force transfer member D is provided with a cavity 82 defining a seat for a vent snap disc 84. A secondary pressure reducer disc is movably guided within cavity 82 on force transfer member D. Vent disc actuating means on secondary pressure reducer disc 86 is in the form of a ring-like projection 88 engaging snap disc 84.

A pin 90 is centrally secured to force transfer member D, and extends through central holes 92, 94 in vent snap disc 84 and secondary pressure reducer disc 86. Pin 90 has a sharp point 96 positioned adjacent diaphragm 32 in facing relationship thereto.

A plurality of holes 101 in partly closed end 22 of shell 16 provide communication between passage 12 and the interior of shell 16. Pressure acting on diaphragm 32 acts through secondary pressure reducer disc 86 on vent snap disc 84. Force is transferred from vent snap disc 84 to force transfer member D which moves relative to the housing C and applies force against the outer periphery of switch snap disc 80.

The force required to deform vent snap disc 84 is substantially greater than the force required deform switch snap disc 80. When the pressure in passage 12 reaches a first predetermined pressure, switch snap disc 80 will begin flattening out, and will snap to an oppositely bowed configuration upon movement to a point slightly less than its neutral flat position. Transfer pin 74 will no longer hold switch arm 58 closed, and contacts 54, 60 will separate under the biasing force in switch arm 58. Switch snap disc 80 will remain in its oppositely bowed position as long as it is held there by force transfer member D.

When the pressure in passage 12 drops to a certain level below the first predetermined pressure, the snap disc will begin flattening out from its oppositely bowed position under the influence of its own internal stress because the force applied thereto by force transfer member D and actuating ring 76 will be insufficient to hold it in its oppositely bowed position. Upon approaching its neutral point, snap disc 80 will snap to the position shown in FIGS. 1 and 2 for closing switch 61. This cycling action of switch 61 will take place to maintain a predetermined pressure in passage 12 by turning the compressor on and off.

In the event the pressure continues to rise in passage 12 after switch snap disc 80 snaps to its oppositely bowed position and contacts 54, 60 are open, the pressure acting on secondary reducer disc 86 will become sufficient to start deforming vent snap disc 84. When vent snap disc 84 moves to a point slightly less than its neutral position, it will snap to an oppositely bowed configuration, and secondary pressure reducer disc 86 will move within cavity 82 a sufficient distance to allow diaphragm 32 to be pierced by point 96 on pin 90. Pressure in passage 12 will then be vented through the interior of housing member C and vent opening 50. The malfunction that caused the emergency venting to take place will then have to be corrected, and combined pressure cutoff and pressure relief valve B will have to be replaced.

FIG. 3 shows peripheral wall 40 of housing member C as having a plurality of circumferentially-spaced longitudinal grooves 105, 106 and 107 in the internal surface thereof. External longitudinal projections 115, 116 and 117 on force transfer member D are respectively received in grooves 105, 106 and 107. The length of the grooves is longer than the length of the projections for allowing reciprocating movement of force transfer means D within the peripheral wall of housing member C.

Figure 4:
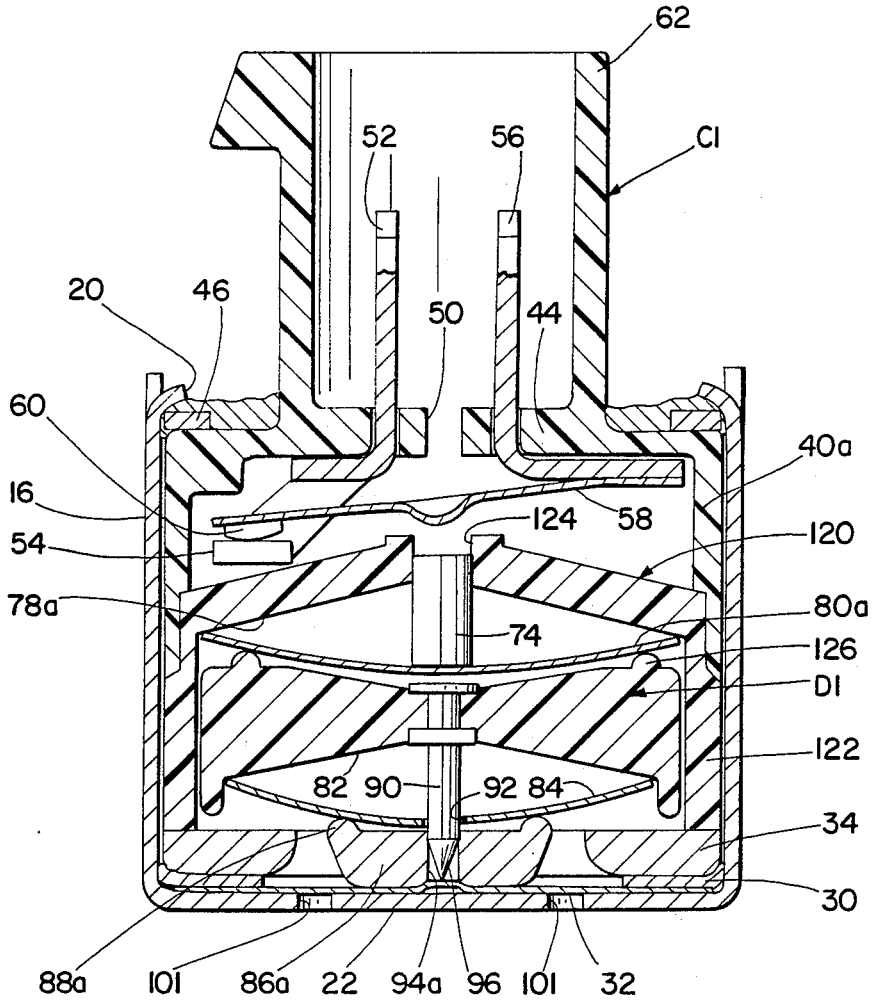
FIG. 4 is a cross-sectional elevational view similar to FIG. 1 and showing another embodiment.

FIG. 4 shows another arrangement wherein housing member C1 has a shortened peripheral wall **40*a*, and a cup-like generally cylindrical disc seat member 120 has its peripheral wall 122 welded or otherwise secured thereto. Disc seat member 120 has a cavity 78*a* providing a seat for a snap disc 80*a* which is positioned reversed from the position of disc 80 in FIGS. 1 and 2. Thus, the normal bowed configuration of snap disc 80*a* is downward as shown in FIG. 4 instead of upward a shown for disc 80 in FIGS. 1 and 2**.

Transfer pin 74 extends through a suitable central hole 124 in switch snap disc seat member 120 for cooperation with movable switch arm 58.

Force transfer member D1 has switch snap disc operating means thereon in the form of a ring-like projection 126 engaging switch snap disc **80*a***.

Secondary pressure reducer disc **86*a* has a central hole 94*a* therethrough for receiving pin 90. Secondary pressure reducer disc 86*a* is guided for longitudinal movement on pin 90**.

The operation of the embodiment of FIG. 4 is similar to that of the embodiment of FIGS. 1 and 2. The force required to deform vent snap disc 84 is substantially greater than the force required to deform switch snap disc **80*a*. When the pressure acting on diaphragm 32 reaches a first predetermined pressure, force is transferred from diaphragm 32 to secondary pressure reducer 86*a* and then to vent snap disc 84. Force is transferred from vent snap disc 84 to movable force transfer member D1 which acts on switch snap disc 80a through projection 126 to begin flattening snap disc 80a out. Upon movement of snap disc 80a slightly past its neutral position, it snaps to an opposite bowed configuration, and moves transfer pin 74 longitudinally into engagement with switch arm 58 for bending same upward in FIG. 1 to separate contacts 54, 60. When the pressure falls a predetermined amount below the first predetermined pressure, the force acting on snap disc 80a through force member D1 will be insufficient to hold it in its reverse bowed configuration and will begin flattening out. Upon movement slightly past its neutral flat position, switch snap disc 80a will again snap back to the bowed configuration shown in FIG. 4** to close the switch. This cycling action will continue to turn the compressor on and off.

In the event of a malfunction when the switch is open and the pressure continue to build, the force of diaphragm 32 acting on secondary pressure reducer disc 86a will be sufficient to begin deforming vent snap disc 84 toward a flat configuration. Upon movement of snap disc 84 to a point slightly less than its neutral position, it will snap to a reverse bowed configuration, and secondary pressure reducer disc 86a will move into cavity 82 a sufficient distance to cause diaphragm 32 to be ruptured by pin 90. The pressure will then be vented through the interior of the housing to vent opening 50.

In the arrangements shown and described, switch snap disc 80, 80a defines a movable switch operating means for moving the switch between its open and closed positions. Vent snap disc 84 defines a movable vent operating means for opening the normally closed vent. Movement of the vent operating means to its vent opening position ruptures the diaphragm 32. Diaphragm 32 defines a movable pressure responsive means for operating the movable switch operating means and the movable vent operating means respectively defined by snap discs 80 and 84.

When a first predetermined pressure is reached, the pressure responsive means defined by diaphragm 32 acts on the movable switch operating means defined by snap disc 80 to move same to a switch open position If the pressure rises to a predetermined pressure greater than the first predetermined pressure, the pressure responsive means defined by diaphragm 32 acts on the movable vent operating means defined by snap disc 84 to move same to its vent opening position for rupturing diaphragm 32. The force transmitting means defined by force transmitting member D is positioned between the switch operating means and the vent operating means defined by snap discs 80, 84. In the arrangement of FIGS. 1 and 2, the force transfer means D provides disc seats in cavities 78, 82 for both of discs 80, 84. In the arrangement of FIG. 4, force transfer means D1 provides a disc seat in cavity 82 only for vent snap disc 84. The disc seat for switch snap disc 80a is provided in cavity 78a of disc seat member 120.

The movable switch operating means and the movable vent operating means are assembled in series with one another, and force is transmitted through one for operating the other.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. A pressure cutoff and relief valve comprising a housing, a normally closed switch in said housing movable between closed and open positions, a normally closed pressure relief vent in said housing, movable switch operating means in said housing for moving said switch between said closed and open positions, said switch operating means including a switch operating snap disc snapable between opposite bowed positions, movable vent operating means in said housing for opening said vent, said vent operating means including a vent operating snap disc snapable between opposite bowed positions, movable pressure responsive means for operating said switch operating means and said vent operating means, said pressure responsive means and said switch operating means being responsive to a first predetermined pressure acting on said pressure responsive means for snapping said switch operating snap disc in one direction for opening said switch and being responsive to a subsequent pressure less than said first predetermined pressure for snapping said switch operating snap disc in an opposite direction for closing said switch, and said pressure responsive means and said vent operating means being responsive to a second predetermined pressure greater than said first predetermined pressure acting on said pressure responsive means for snapping said vent operating snap disc from one of said opposite bowed positions thereof to the other for opening said vent.

2. The device of claim 1 including a disc seat in said housing for each of said discs.

3. The device of claim 2 wherein said disc seats for both of said discs are on said force transfer member.

4. The device of claim 2 wherein said disc seat for said vent snap disc is on said force transfer member, and a fixed disc seat member in said housing having a disc seat thereon for said switch snap disc.

5. The device of claim 1 including a primary pressure reducer member in said housing between said switch and said switch snap disc, and a secondary pressure reducer member in said housing between said vent snap disc and said diaphragm.

6. A combined pressure cutoff and pressure relief valve including a housing having opposite end portions, a normally closed switch adjacent one of said housing end portions and being movable between closed and open positions, a movable pressure responsive diaphragm adjacent the other of said housing end portions, a pressure vent in said one end portion of said housing, a switch operating snap disc in said housing adjacent said switch, a vent operating snap disc in said housing adjacent said diaphragm, a movable force transfer member between said discs, a pin carried by said force transfer member and having a sharp end adjacent said diaphragm, and a hole in said vent operating snap disc through which said pin extends, said diaphragm being responsive to a first pressure acting thereon for operating said switch operating snap disc to open said switch and being responsive to a second pressure greater than said first pressure for operating said vent operating snap disc which causes said pin sharp end to pierce said diaphragm and thereby vent pressure through said diaphragm to said pressure vent.

7. A combined pressure cutoff and pressure relief valve having a normally closed switch movable between open and closed positions and an openable normally closed pressure vent, series arranged movable switch operating means and movable vent operating means for respectively opening and closing said switch and for opening said vent, movable pressure responsive means for sequentially moving said operating means to operate same, said pressure responsive means acting through one of said operating means which thereby acts on the other of said operating means, said pressure responsive means including a diaphragm, a pin which pierces said diaphragm with sufficient force and vents pressure therethrough when said vent operating means is operated by movement of same, and said vent operating means being movable with said pressure responsive means during operation of said switch operating means, and said vent operating means being movable relative to said pressure responsive means for rupturing said diaphragm.

8. A pressure cutoff and relief valve comprising a housing, a normally closed switch in said housing movable between closed and open positions, a normally closed pressure relief vent in said housing, movable switch operating means in said housing for moving said switch between said closed and open positions, movable vent operating means in said housing for opening said vent, movable pressure responsive means for operating said switch operating means and said vent operating means, said pressure responsive means and said switch operating means being responsive to a first predetermined pressure acting on said pressure responsive means for opening said switch and being responsive to a subsequent pressure less than said first predetermined pressure for closing said switch, said pressure responsive means and said vent operating means being responsive to a second predetermined pressure greater than said first predetermined pressure acting on said pressure responsive means for opening said vent, said movable pressure responsive means including a diaphragm, and said movable vent operating means opening said vent by rupturing said diaphragm.

9. The device of claim 8 wherein said switch operating means and said vent operating means include snap discs.

10. A pressure cutoff and relief valve comprising a housing, a normally closed switch in said housing movable between closed and open positions, a normally closed pressure relief vent in said housing, movable switch operating means in said housing for moving said switch between said closed and open positions, movable vent operating means in said housing for opening said vent, movable pressure responsive means for operating said switch operating means and said vent operating means, said pressure responsive means including a movable diaphragm, movable force transfer means interposed between said switch operating means and said vent operating means and including a pin having a sharp end facing toward said diaphragm, said pressure responsive means and said switch operating means being responsive to a first predetermined pressure acting on said pressure responsive means for opening said switch and being responsive to a subsequent pressure less than said first predetermined pressure for closing said switch, and said pressure responsive means and said vent operating means being responsive to a second predetermined pressure greater than said first predetermined pressure acting on said pressure responsive means and opening said vent by piercing said diaphragm on said sharp end of said pin.

11. The device of claim 10 wherein said switch operating means and said vent operating means include snap discs.

* * * * *